US007794045B2

(12) United States Patent
Nakano

(10) Patent No.: US 7,794,045 B2
(45) Date of Patent: Sep. 14, 2010

(54) INK-JET RECORDING APPARATUS

(75) Inventor: Yasushi Nakano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 431 days.

(21) Appl. No.: 11/845,709

(22) Filed: Aug. 27, 2007

(65) Prior Publication Data

US 2007/0296759 A1 Dec. 27, 2007

Related U.S. Application Data

(63) Continuation of application No. 11/157,505, filed on Jun. 21, 2005, now Pat. No. 7,290,851.

(30) Foreign Application Priority Data

Jul. 7, 2004 (JP) ..... 2004-200490

(51) Int. Cl.
*B41J 2/165* (2006.01)

(52) U.S. Cl. ..... 347/31; 347/35

(58) Field of Classification Search ..... 347/15, 347/16, 31, 35

See application file for complete search history.

(56) References Cited

U.S. PATENT DOCUMENTS 6,786,587 B2 * 9/2004 Koitabashi ..... 347/96
6,953,237 B2 * 10/2005 Otsuki ..... 347/41
7,029,096 B2 * 4/2006 Weijkamp et al. ..... 347/40
7,290,851 B2 * 11/2007 Nakano ..... 347/31
2004/0160478 A1 8/2004 Weijkamp et al.

FOREIGN PATENT DOCUMENTS

JP 10-337886 12/1998

* cited by examiner

*Primary Examiner*—Juanita D Stephens
(74) *Attorney, Agent, or Firm*—Canon USA Inc. IP Div

(57) ABSTRACT

An ink-jet recording apparatus capable of high-quality recording without smudging recording media and the interior of the recording apparatus even when a frameless recording operation using reactive ink that coheres with each other when mixed together is performed. The ink-jet recording apparatus includes a recording head having a first nozzle array and a second nozzle array, and an ink absorbent facing the nozzle arrays. The first nozzle array discharges a first ink, and the second nozzle array discharges a second ink. The first and second ink is a reactive ink that coheres with each other when mixed together. During the frameless recording operation on a front edge of the recording medium, some of the first and second ink discharged from the respective nozzle arrays of the recording head adheres to the front edge, and some of the ink adheres to separate positions on the ink absorbent.

4 Claims, 8 Drawing Sheets

INK-JET RECORDING APPARATUS

This application is a continuation of U.S. patent application Ser. No. 11/157,505 filed Jun. 21, 2005, now issued U.S. Pat. No. 7,290,851, which claims priority from Japanese Patent Application No. 2004-200490 filed Jul. 7, 2004, both of which are hereby incorporated by reference herein in their entirety.

BACKGROUND OF THE INVENTION

1. Field of the Invention

The present invention relates to ink-jet recording apparatuses that record on recording media by discharging ink from recording heads, and in particular, relates to ink-jet recording apparatuses capable of performing a frameless recording on recording media.

2. Description of the Related Art

Hitherto, ink-jet recording apparatuses capable of performing a frameless recording on ends of recording media are well known (for example, Japanese Patent Laid-Open No. 10-337886).

In an ink-jet recording apparatus disclosed in Japanese Patent Laid-Open No. 10-337886, an ink absorbent is disposed at a position facing a nozzle array on a recording head. Frameless recording is performed by discharging ink from nozzles while an end of a recording medium is located between the nozzle array and the ink absorbent. Part of the discharged ink adheres onto the recording medium, and the other part adheres onto the ink absorbent. With this structure, unused ink discharged off the end of the recording medium penetrates into the ink absorbent. Thus, the ink does not scatter easily in the form of mist, and as a result, the recording medium and the recording apparatus are not easily smudged by the ink.

FIG. 9 illustrates an exemplary layout of nozzle arrays of a recording head installed in such an ink-jet recording apparatus. A recording head 101 shown in FIG. 9 is used for producing color images, and includes four nozzle arrays 102*a* to 102*d* disposed at predetermined intervals in the main scanning direction. These nozzle arrays 102 include a plurality of nozzles (not shown) aligned in the sub-scanning direction. Each of the nozzle arrays 102 discharges a specific color ink.

Normally, the recording head 101 having the above-described structure discharges ink while moving in the main scanning direction. As a result, the different color ink discharged from the nozzle arrays 102 adheres onto the recording medium so as to produce color images.

As described above, the recording head in general includes nozzle arrays that discharge specific color ink, and various types of ink are supplied to the nozzle arrays. For example, used in some cases are reactive ink containing particles that cohere with each other when the different reactive ink is mixed together.

However, when the recording head shown in FIG. 9 is installed in the ink-jet recording apparatus disclosed in Japanese Patent Laid-Open No. 10-337886 so as to perform a frameless recording using the reactive ink, the following problems can occur. That is to say, the reactive ink discharged from the respective nozzle arrays of the recording head while the recording head moves in the main scanning direction adheres onto a substantially fixed position (zone) of the ink absorbent. Then, the reactive ink is mixed together on the top surface of the ink absorbent or inside the ink absorbent adjacent to the top surface and coheres with each other before penetrating into the ink absorbent. As a result, a solid is produced adjacent to the top surface of the ink absorbent by the cohesion, and the ink subsequently adhering onto the ink absorbent hardly penetrates into the ink absorbent. This leads to an inefficient use of the ink absorbent. Moreover, if the solid is produced adjacent to the top surface of the ink absorbent by the cohesion, the ink discharged to the ink absorbent may scatter in the form of mist without penetrating into the ink absorbent. The ink in the form of mist can become a cause of smudges on the recording medium.

SUMMARY OF THE INVENTION

The present invention is directed to an ink-jet recording apparatus capable of high-quality recording without smudging recording media and the interior of the recording apparatus even when a frameless recording operation using reactive ink that coheres with each other when mixed together is performed.

In one aspect of the present invention, an ink-jet recording apparatus includes a recording head having at least a first nozzle array configured to discharge a first ink and a second nozzle array configured to discharge a second ink, the first nozzle array and the second nozzle array being disposed along a feeding direction of a recording medium, the first ink and the second ink cohering with each other when mixed together. The apparatus also includes an ink absorbent disposed at a position facing the first and second nozzle arrays of the recording head. The ink-jet recording apparatus is characterized in that some of the first and second ink discharged from the respective nozzle arrays while the recording head moves in a direction orthogonal to the feeding direction of the recording medium adheres to an end of the recording medium during a frameless recording operation, and that the first nozzle array and the second nozzle array are shifted with respect to each other in the feeding direction of the recording medium such that some of the first ink not adhering to the end of the recording medium adheres to a first position on the ink absorbent during the frameless recording and the second ink not adhering to the end of the recording medium adheres to a second position on the ink absorbent.

In the ink-jet recording apparatus according to the present invention, the ink is discharged to separate positions on the ink absorbent. Therefore, even when the frameless recording operation using reactive ink that coheres with each other when mixed together is performed on the end of the recording medium, the ink cohesion on the top surface of the ink absorbent or inside the ink absorbent adjacent to the top surface can be regulated. Thus, a solid is not easily produced adjacent to the top surface of the ink absorbent by the cohesion, and unused ink can be efficiently retained in the ink absorbent. Since the solid is not easily produced, the ink absorbent can appropriately absorb the ink for a long period of time. Furthermore, the possibility of the ink scattering in the form of mist is reduced. As a result, the recording medium is not easily smudged by the mist, and high-quality recording on the recording medium can be achieved.

Further features and advantages of the present invention will become apparent from the following description of exemplary embodiments with reference to the attached drawings.

DESCRIPTION OF THE EMBODIMENTS

Embodiments of the present invention will now be described with reference to the drawings.

First Embodiment

Figure 1:
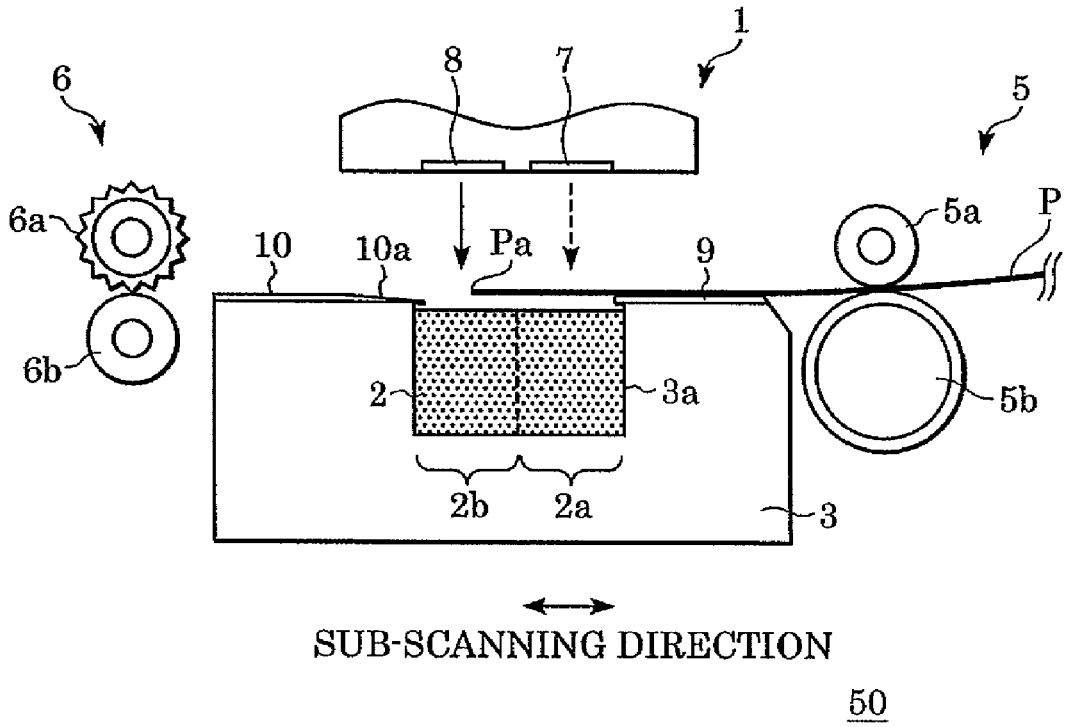
FIG. 1 is a cross-sectional view schematically illustrating an ink-jet recording apparatus according to a first embodiment.
Figure 2:
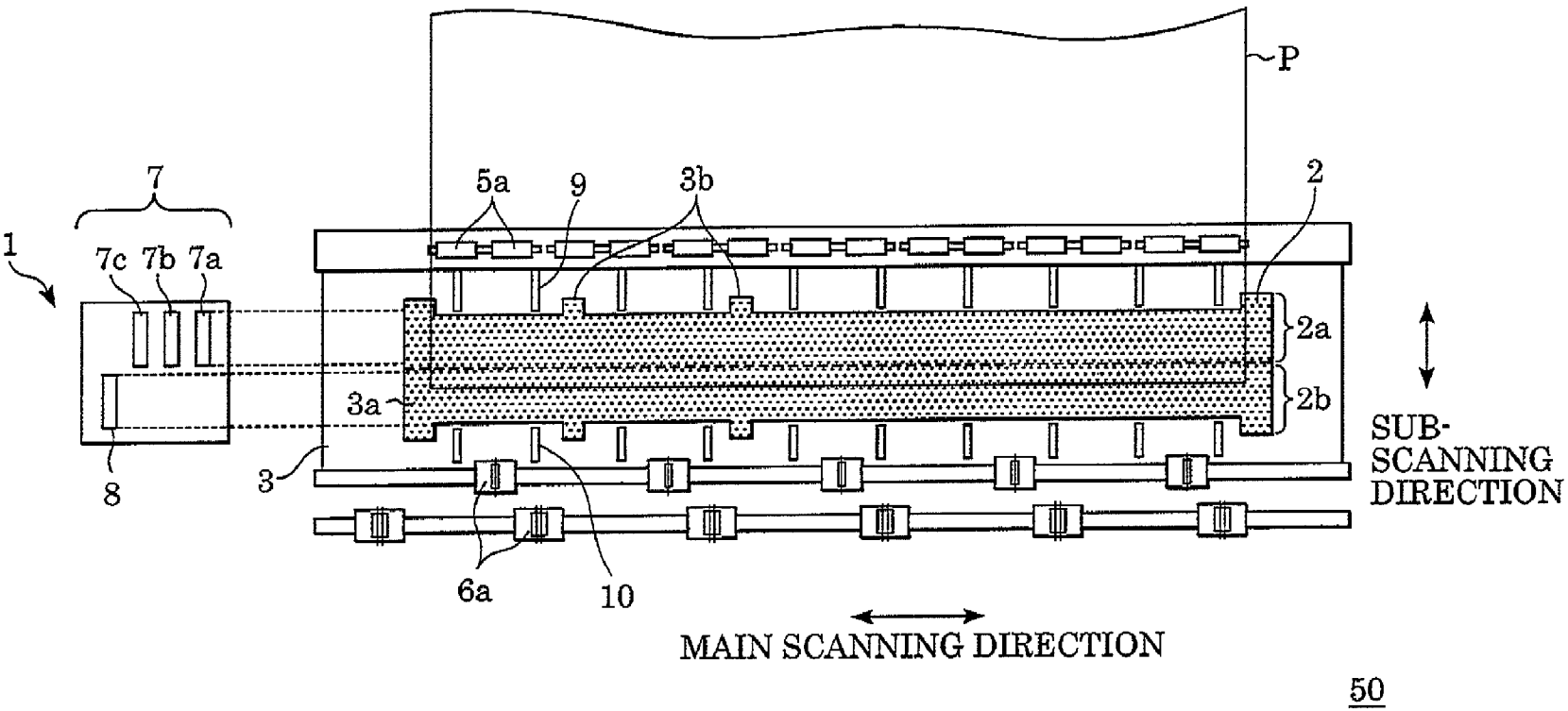
FIG. 2 is a top plan view of the ink-jet recording apparatus shown in FIG. 1.

FIG. 1 is a cross-sectional view schematically illustrating an ink-jet recording apparatus according to a first embodiment. FIG. 2 is a top plan view of the ink-jet recording apparatus shown in FIG. 1.

First, the overall structure of an ink-jet recording apparatus 50 according to the embodiment will be described with reference to FIGS. 1 and 2.

The ink-jet recording apparatus 50 includes a paper-feeding mechanism 5 and a paper-ejecting mechanism 6 for feeding a recording medium P in a sub-scanning direction; a recording head 1 for discharging ink towards the recording medium P while moving in a main scanning direction; and a platen 3 disposed below the recording head 1 and supporting the recording medium P during recording.

The paper-feeding mechanism 5 is disposed upstream of the feeding direction of the recording medium P (on the right side in FIG. 1) from the recording head 1. The mechanism 5 includes a plurality of paper-feeding rollers 5*b* coming into contact with the undersurface of the recording medium P, and a plurality of pinch rollers 5*a* disposed above the paper-feeding roller 5*b*. The paper-ejecting mechanism 6 is disposed downstream from the recording head 1. The mechanism 6 includes a plurality of paper-ejecting rollers 6*b* coming into contact with the undersurface of the recording medium P and a plurality of spur rollers 6*a* disposed above the paper-ejecting rollers 6*b*.

The paper-feeding rollers 5*b*, the pinch rollers 5*a*, the paper-ejecting rollers 6*b*, and the spur rollers 6*a* are disposed over the width of the recording medium P as shown in FIG. 2 so as to smoothly feed the recording medium P.

The recording head 1 includes first nozzle arrays 7 and a second nozzle array 8 for discharging different types of ink. The nozzle arrays 7 and 8 will be described in detail below. The recording head 1 is retained by a carriage (head-retaining member not shown), and moves in the width direction of the recording medium P (the main scanning direction) depending on the reciprocating motion of the carriage in the main scanning direction. Orifice surfaces of the nozzle arrays 7 and 8 on the recording head 1 are horizontal.

The platen 3 is disposed between the paper-feeding mechanism 5 and the paper-ejecting mechanism 6, and includes a groove 3*a* provided at a position facing the nozzle arrays 7 and 8 of the recording head 1. An ink absorbent 2 is disposed in the groove 3*a*. The groove 3*a* and the ink absorbent 2 will be described in detail below. A plurality of ribs 9 and 10 are formed on the top surface of the platen 3 upstream and downstream from the groove 3*a*, respectively. A taper 10*a* is formed upstream of the ribs 10 (adjacent to the groove 3*a*) so as to guide a front edge Pa of the incoming recording medium P. As shown in FIG. 2, the ribs 9 and 10 are formed over the width of the recording medium P.

The ink-jet recording apparatus 50 having the above-described structure operates to make a recording as follows. First, the recording medium P is fed to a predetermined recording start position in the sub-scanning direction by the paper-feeding mechanism 5 and the paper-ejecting mechanism 6, and then the feeding of the recording medium P is halted. Next, ink is discharged from the nozzle arrays 7 and 8 such that a line is recorded while the recording head 1 is moving in the main scanning direction by driving the carriage. Next, the paper-feeding mechanism 5 and the paper-ejecting mechanism 6 are driven again so as to feed the recording medium P in the sub-scanning direction by a predetermined distance. Then, another line is recorded while the recording head 1 is moving again in the main scanning direction. In this manner, a recording is made on the recording medium P by repeating the feeding and the recording of one line.

Next, the nozzle arrays 7 and 8 of the recording head 1 and the modifications will be described. FIGS. 3A to 3D are plan views of various modifications of the recording head.

The recording head 1 according to this embodiment discharges a first ink being a reactive ink from the first nozzle arrays 7, and a second ink being another reactive ink from the second nozzle array 8. For example, one of the first ink and the second ink includes an anionic group, and the other one includes a polyvalent metal salt or a cationic compound. As described above, the first ink and the second ink cohere with each other when they are mixed together.

The ink does not cohere together even when the first ink and the second ink are mixed among themselves. Accordingly, the nozzle arrays 7 and 8 formed in the ink-jet recording apparatus according to this embodiment may be disposed such that the first ink discharged from the first nozzle arrays 7 and the second ink discharged from the second nozzle array 8 are not mixed together. FIGS. 3A to 3D show various modifications as examples.

Figure 3A:
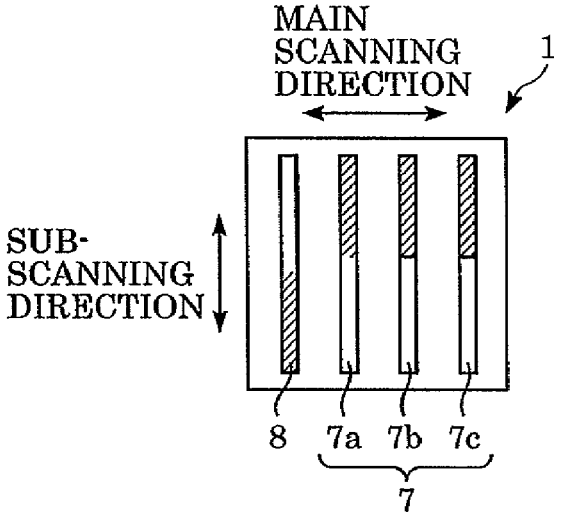
FIGS. 3A to 3D are plan views of various modifications of a recording head.

The recording head 1 shown in FIG. 3A includes three nozzle arrays 7*a*, 7*b*, and 7*c* serving as first nozzle arrays 7 and a second nozzle array 8. For example, different color ink is discharged from the first nozzle arrays 7, and a black ink is discharged from the second nozzle array 8.

The nozzle arrays 7 and 8 include a plurality of nozzles (not shown) arranged in the sub-scanning direction, and extending in the sub-scanning direction. Moreover, the nozzle arrays 7 and 8 are disposed so as to overlap with each other in the main scanning direction (when superimposed in the main scanning direction).

When frameless recording is performed with this recording head 1, the recording head 1 discharges the ink only from shaded areas of the slender nozzle arrays 7 and 8. That is to say, in the first nozzle arrays 7, the ink is discharged only from half portions adjacent to the upstream in the sub-scanning direction (upper half in the drawing), and in the second nozzle array 8, the ink is discharged only from a half portion adjacent to the downstream in the sub-scanning direction (lower half in the drawing). Thus, a position where the first ink discharged from the first nozzle arrays 7 adheres and a position where the second ink discharged from the second nozzle array 8 adheres are separated on the ink absorbent 2.

Figure 3B:
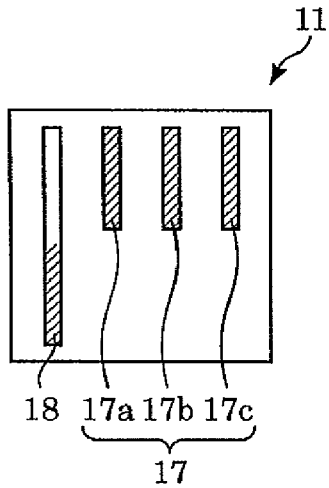

According to a recording head 11 shown in FIG. 3B, a second nozzle array 18 is identical to that in FIG. 3A. However, first nozzle arrays 17*a*, 17*b*, and 17*c* are shorter than the first nozzle arrays 7 in FIG. 3A, and only half portions adjacent to the upstream are left.

Figure 3C:
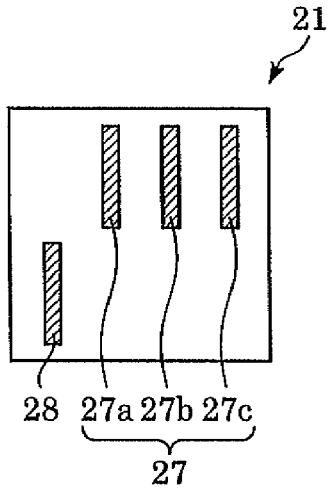

According to a recording head 21 shown in FIG. 3C, a second nozzle array 28 is shorter than the second nozzle array 8 in FIG. 3A, and only a half portion adjacent to the downstream is left. First nozzle arrays 27*a*, 27*b*, and 27*c* are identical to those in FIG. 3B.

Figure 3D:
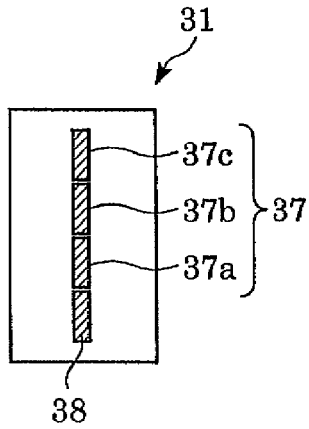

According to a recording head 31 shown in FIG. 3D, first nozzle arrays 37*a*, 37*b*, and 37*c* are aligned from the downstream to the upstream of the feeding direction of the recording medium in that order along the sub-scanning direction, and a second nozzle array 38 is aligned furthest downstream.

As shown in FIGS. 3A to 3D, the recording heads may have any structure as long as the first nozzle arrays 7, 17, 27, and 37 and the second nozzle arrays 8, 18, 28, and 38 can discharge the first ink and the second ink, respectively, to separate positions. This can be achieved by using only parts of the slender nozzle arrays 7, 8, and 18 when using the structures shown in FIGS. 3A and 3B. Also, when using the structures shown in FIGS. 3C and 3D, the first ink and the second ink can be discharged to separate positions even though all the nozzle arrays are used since the first nozzle arrays and the second nozzle arrays are disposed so as not to overlap with each other.

The number of the first and second nozzle arrays formed in the recording heads is not specifically limited. For example, two or more second nozzle arrays 8 may be formed in the structure shown in FIG. 3A. Also, in the structure shown in FIG. 3A, any areas of the nozzle arrays 7 and 8 may be used instead of the shaded areas as long as the first ink and the second ink do not overlap with each other.

Next, the groove 3*a* of the platen 3 and the ink absorbent 2 will be described with reference to FIGS. 1 and 2.

As shown in FIG. 1, the groove 3*a* is trenched in the platen 3 from the top surface to a predetermined depth, and the bottom surface is horizontal. The groove 3*a* extends in the sub-scanning direction so as to include both the first nozzle arrays 7 and the second nozzle array 8. As shown in FIG. 2, the groove 3*a* extends longer than the width of the recording medium P (the length in the main scanning direction), and more specifically, protrudes from both sides of the feeding path of the recording medium P. Thus, the recording medium P is always fed on the groove 3*a* regardless of the size.

Furthermore, as shown in FIG. 2, the groove 3*a* has several projections 3*b* partially extending in the sub-scanning direction. In this embodiment, the projections 3*b* are formed at each end of the groove 3*a*. In addition, two projections 3*b* are formed in the intermediate positions of the groove 3*a*. The size of the recording medium P shown in the drawings is illustrated as an example. However, the projections 3*b* formed at both ends of the groove 3*a* as described above have the following advantage. Since the area of the ink absorbent 2 disposed in the groove 3*a* can be partially increased, unused ink appropriately adheres to the ink absorbent 2 during frameless recording on the recording medium P.

The two projections 3*b* are disposed asymmetrically with respect to the central line of the sub-scanning direction passing through the center of the groove 3*a* in the main scanning direction. This asymmetrical arrangement of the projections 3*b* prevents misinsertion of the ink absorbent 2 into the groove 3*a*.

Next, the ink absorbent 2 will be described. The ink absorbent 2 is a single component for absorbing and retaining the discharged ink, and is composed of, for example, polyurethane foam. The ink absorbent 2 has substantially the same profile as the interior of the groove 3*a*. That is to say, the ink absorbent 2 extends longer than the width of the recording medium P when viewed from above, and includes several projections (with no reference numeral) fitted into the projections 3*b* of the groove 3*a* in the longitudinal direction.

Moreover, as shown in FIG. 1, the top surface of the ink absorbent 2 is slightly lower than that of the platen 3 when the ink absorbent 2 is disposed in the groove 3*a*. Half of the ink absorbent 2 adjacent to the upstream in the sub-scanning direction is a zone 2*a* for catching the first ink discharged from the first nozzle arrays 7, and half of the ink absorbent 2 adjacent to the downstream is a zone 2*b* for catching the second ink discharged from the second nozzle array 8.

The ink absorbent 2 according to this embodiment is composed of a single component. However, the ink absorbent is not limited to that described above, and may be composed of multiple components that are in close contact with each other.

Next, operations for frameless recording with the ink-jet recording apparatus 50 according to this embodiment having the above-described structure will be described with reference to FIGS. 4A and 4B.

Figure 4A:
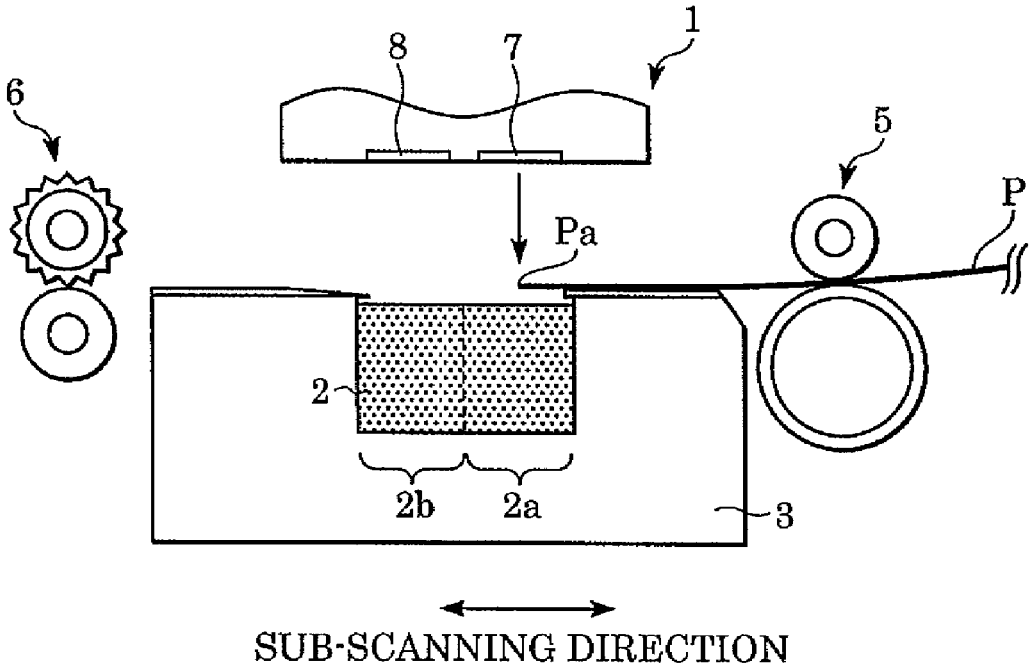
FIGS. 4A and 4B are schematic views illustrating operations of the recording head of the ink-jet recording apparatus shown in FIG. 1.

First, as shown in FIG. 4A, the paper-feeding mechanism 5 is driven to feed the recording medium P such that the front edge Pa of the recording medium P is located at a position below the first nozzle arrays 7. Next, while the feeding of the recording medium P is halted, the ink is discharged only from the first nozzle arrays 7 at the same time as the recording head 1 moves in the main scanning direction (see FIG. 2). In this manner, part of the discharged ink adheres to an end of the recording medium P (a portion adjacent to the front edge Pa) so as to make a recording on the end. Also, the unused ink discharged from the first nozzle arrays 7 to an area off the end of the recording medium P adhere to the top surface of the zone 2*a* located upstream of the ink absorbent 2. According to these recording operations, the colors corresponding to the ink of the first nozzle arrays 7*a*, 7*b*, and 7*c* (see FIG. 2 or 3A) are included in a produced image piece.

Figure 4B:
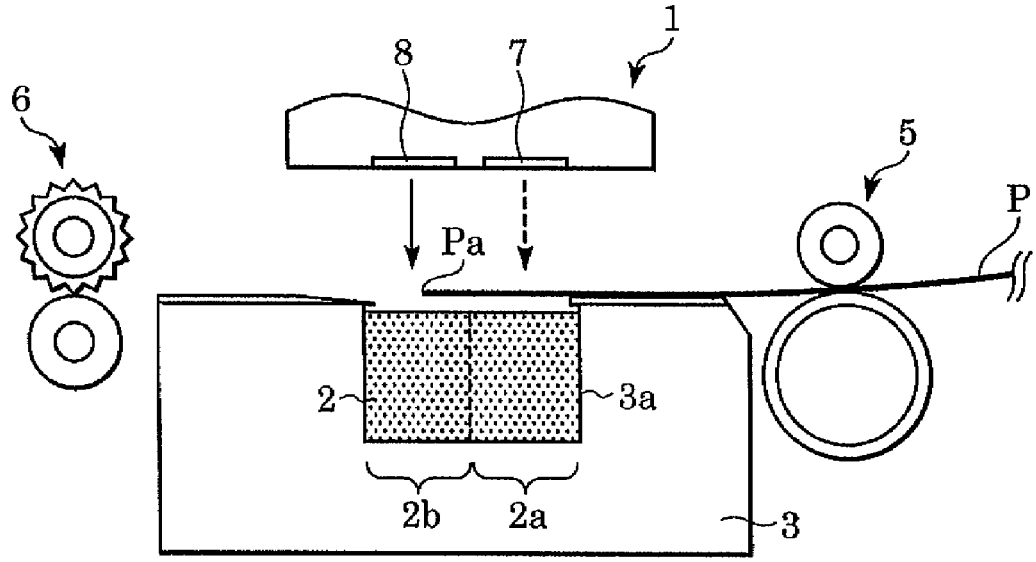

Next, as shown in FIG. 4B, the paper-feeding mechanism 5 is driven again to feed the recording medium P such that the front edge Pa of the recording medium P is located at a position below the second nozzle array 8. Next, while the feeding of the recording medium P is halted, the ink is simultaneously discharged from both the first nozzle arrays 7 and the second nozzle array 8 as the recording head 1 moves. In this manner, part of the ink discharged from the second nozzle array 8 adheres onto the end of the recording medium P where the ink discharged from the first nozzle arrays 7 in the preceding step exists, and a final image piece at the end is produced. Also, the unused ink discharged from the second nozzle array 8 to an area off the end of the recording medium P adheres to the top surface of the zone 2*b* located downstream of the ink absorbent 2. Furthermore, in these recording operations, the ink is also discharged from the first nozzle arrays 7. Accordingly, as in the above-described step, an image piece for another line including the colors corresponding to the ink of the first nozzle arrays 7 is produced in an area facing the first nozzle arrays 7.

Subsequently, a desired image is produced on the recording medium P by repeating the above-described operations of feeding and recording. The frameless recording can be performed also on the rear edge of the recording medium P (not shown) by conducting the same operations as above.

As shown in FIG. 3A, the recording head 1 includes the slender nozzle arrays 7 and 8. The recording operations where the ink is discharged from the limited portions of the nozzle arrays indicated by the oblique lines in FIG. 3A may be performed only during frameless recording. That is to say, when the front edge Pa of the recording medium P is fed to a position downstream of that shown in FIG. 4B such that the groove 3*a* of the platen 3 is covered with the recording medium P, the ink discharged from the nozzle arrays 7 and 8 are basically all used. Therefore, the ink may be selectively discharged from all the nozzles in the slender nozzle arrays 7 and 8 so as to make a recording. As a result, an area of an image piece produced by a single scanning of the recording head 1 is increased, resulting in an improvement in the recording speed.

In these recording operations, however, the unused ink discharged from the first nozzle arrays 7 and the second nozzle array 8 to areas off both the ends of the recording medium P in the width direction adhere to the ink absorbent 2. Therefore, the ink discharge from the nozzle arrays 7 and 8 described above may be selectively performed by determining, for example, whether the frameless recording on both the ends of the recording medium P is also performed or not.

According to the above-described structures and operations of the ink-jet recording apparatus 50 of this embodiment, the first ink and the second ink, which react with each other, are discharged from the first nozzle arrays 7 and the second nozzle array 8, respectively, to separate positions so as not to be mixed together. More specifically, according to this embodiment, the first ink discharged from the first nozzle arrays 7 adheres to the top surface of the zone 2*a* located upstream of the ink absorbent 2. On the other hand, the second ink discharged from the second nozzle array 8 adheres to the top surface of the zone 2*b* located downstream of the ink absorbent 2. Therefore, both ink are not mixed together adjacent to the top surface of the ink absorbent 2. As a result, the ink cohesion adjacent to the top surface of the ink absorbent 2 can be regulated.

The first ink and the second ink that adhered to the separate positions of the top surface of the ink absorbent 2 show the following behavior. First, the ink that adhered onto the zone 2*a* and the zone 2*b* penetrate through the ink absorbent 2 by capillary force of the ink absorbent 2 and the weight of the ink so as to slightly expand downward. Subsequently, the ink is mixed together in the vicinity of the border between the zone 2*a* and the zone 2*b* inside the ink absorbent 2. Thus, the ink coheres together inside the ink absorbent 2 so as to form a tabular solid extending in the discharging direction of the ink (vertical direction in the drawing). Since the solid formed by the cohesion separates the zone 2*a* and the zone 2*b*, the first ink and the second ink subsequently penetrating through the zone 2*a* and the zone 2*b* become hard to cohere together through the solid. Accordingly, the first ink and the second ink can be appropriately retained in a separate manner in the ink absorbent 2.

Second Embodiment

According to the first embodiment, the ink absorbent 2 is composed of a single component. The present invention is not limited to that described above, and the ink absorbent may be composed of components having different capillary forces.

Figure 5:
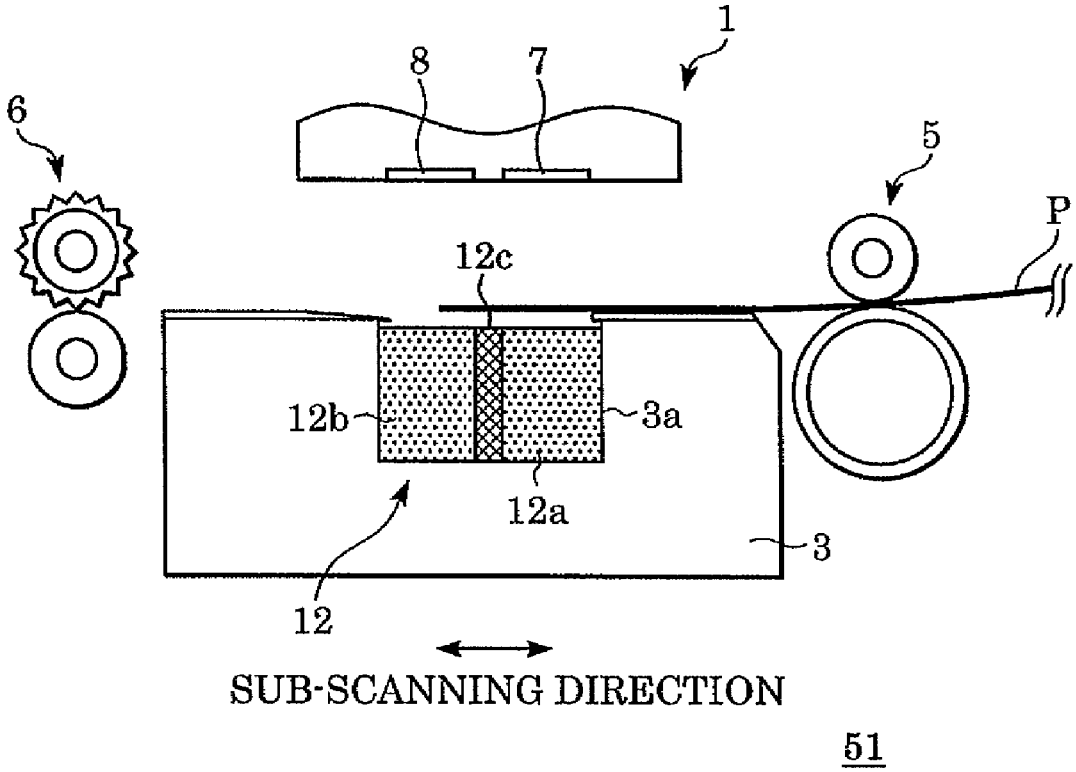
FIG. 5 is a cross-sectional view schematically illustrating an ink-jet recording apparatus according to a second embodiment.

An ink-jet recording apparatus 51 shown in FIG. 5 differs from the ink-jet recording apparatus 50 according to the first embodiment only in terms of the structure of an ink absorbent 12, and the other components have the same structures as those of the ink-jet recording apparatus 50 according to the first embodiment. Accordingly, the same reference numerals as in FIGS. 1 and 2 are used for the components having the same functions, and the descriptions will be omitted.

In the ink-jet recording apparatus 51 according to this embodiment, the ink absorbent 12 includes ink-absorbing elements 12*a* and 12*b* having substantially the same capillary forces, and an intermediate ink-absorbing element 12*c* having a capillary force smaller than those of the ink-absorbing elements 12*a* and 12*b*. The ink-absorbing elements 12*a* to 12*c* are all composed of, for example, polyurethane foam as in the case for the first embodiment.

The heights of the ink-absorbing elements 12*a* to 12*c* are the same such that the top surfaces thereof are arranged in the same plane when they are disposed in the groove 3*a*. Moreover, the ink-absorbing elements 12*a* and 12*b* have substantially the same cross-sectional shapes. On the other hand, the ink-absorbing element 12*c* has a cross-sectional shape thinner than those of the ink-absorbing elements 12*a* and 12*b*. The ink-absorbing elements 12*a* to 12*c* having the above-described structures are disposed in the groove 3*a*, and the ink-absorbing elements 12*a* and 12*b* are partitioned by the intermediate ink-absorbing element 12*c*. Moreover, two adjacent ink-absorbing elements are in close contact with each other.

When the frameless recording described with reference to FIG. 4 is performed with the ink-jet recording apparatus 51 according to this embodiment, the first ink discharged from the first nozzle arrays 7 adheres onto the ink-absorbing element 12*a* adjacent to the upstream, and the second ink discharged from the second nozzle array 8 adheres onto the ink-absorbing element 12*b* adjacent to the downstream. The ink that adhered onto the ink-absorbing elements 12*a* and 12*b* penetrates substantially downward. Subsequently, the ink reaches the bottom surfaces of the ink-absorbing elements 12*a* and 12*b*, and expands in the vicinity of the bottom surfaces. Part of the ink moves to the border with the ink-absorbing element 12*c*. Since the capillary force of the intermediate ink-absorbing element 12*c* is smaller than those of the ink-absorbing elements 12*a* and 12*b*, penetration speed of the ink varies in directions. That is to say, the ink penetrates through the ink-absorbing elements 12*a* and 12*b* so as to expand in the main scanning direction more preferentially than penetrating through the ink-absorbing element 12*c*.

According to this structure, the moving directions of the ink in the ink absorbent can be regulated by partially setting the capillary force of the ink absorbent 12 at a small value. As a result, the first ink and the second ink can be separately retained. In addition, the gap between the first nozzle arrays 7 and the second nozzle array 8 can be slightly smaller than the width of the ink-absorbing element 12*c*. Since the ink discharged to the ink-absorbing element 12*c* having a relatively small capillary force moves to the adjacent ink-absorbing element 12*a* or 12*b* having a higher capillary force, the area of the ink-absorbing element 12*c* can be utilized in the most effective manner.

In this embodiment, the ink absorbent composed of the three ink-absorbing elements 12*a*, 12*b*, and 12*c* was described. However, the ink absorbent is not limited to that described above, and may be composed of a single component having a partially small capillary force.

Third Embodiment

Figure 6:
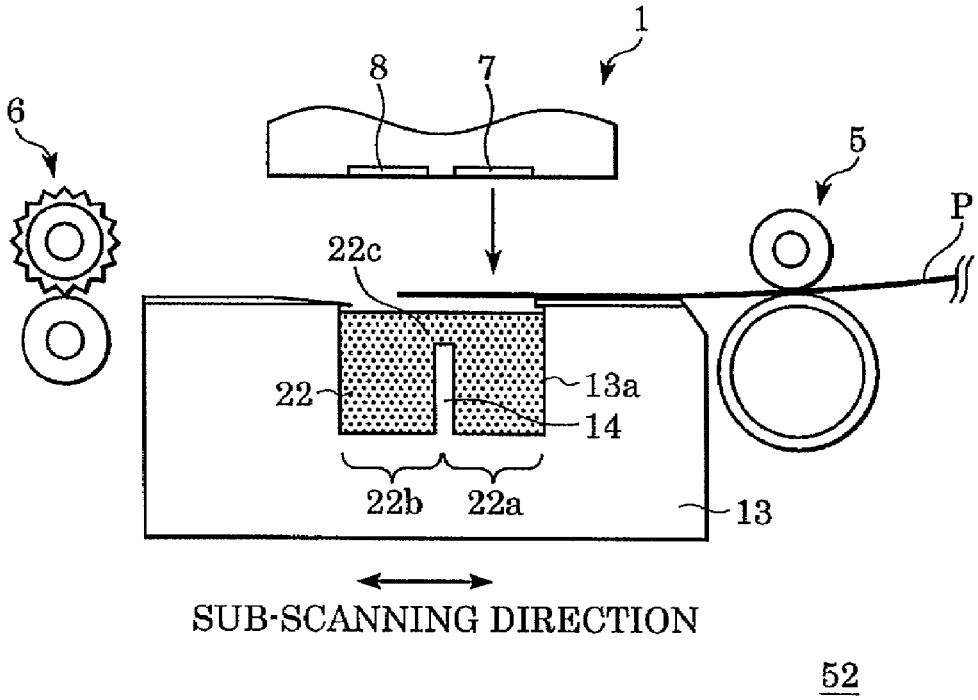
FIG. 6 is a cross-sectional view schematically illustrating an ink-jet recording apparatus according to a third embodiment.

The shapes of the ink absorbent and the groove of the platen may be formed as in the case shown in FIG. 6.

An ink-jet recording apparatus 52 shown in FIG. 6 includes a tabular partition 14 protruding from inside a groove 13*a* of a platen 13. The other components have the same structures as in the ink-jet recording apparatus 50 according to the first embodiment except for an ink absorbent 22. Accordingly, the same reference numerals as in FIGS. 1 and 2 are used for the components having the same functions, and the descriptions will be omitted.

As shown in the drawing, the partition 14 is disposed substantially in the middle of the groove 13*a* in the sub-scanning direction, and extends vertically upward from the bottom surface of the groove 13*a*. The height of the partition 14 is smaller than the depth of the groove 13*a*. Moreover, although not shown, the partition 14 extends in the main scanning direction when viewed from above as in, for example, FIG. 2, and is formed over the length of the groove 13*a* in the longitudinal direction. Thus, the groove 13*a* is substantially partitioned into an upstream part and a downstream part in the sub-scanning direction at every site thereof by the partition 14.

The ink absorbent 22 having a substantially U-shaped cross section is disposed inside the groove 13*a*. The ink absorbent 22 includes a zone 22*a* disposed in the upstream part of the groove 13*a* substantially partitioned by the partition 14, a zone 22*b* disposed in the downstream part of the groove 13*a*, and a mixing zone 22*c* connecting these two zones 22*a* and 22*b*. The mixing zone 22*c* connects the zones 22*a* and 22*b* adjacent to the top surface of the ink absorbent 22.

When the frameless recording described with reference to FIG. 4 is performed with the ink-jet recording apparatus 52 according to this embodiment, the first ink and the second ink discharged to the top surfaces of the zones 22*a* and 22*b*, respectively, penetrate substantially downward as in the case for the above-described embodiments. Since the ink absorbent 22 is partitioned from the lower portion thereof by the partition 14, the ink is not mixed together until an amount of ink retained in the ink absorbent 22 exceeds a predetermined value. The penetration directions of the ink through the ink absorbent varies depending on the viscosity of the ink, the capillary force of the ink absorbent 22, and the like. When the capillary force is relatively high, for example, the ink penetrates so as to expand. In this case, part of the first ink and the part of the second ink may move to the mixing zone 22*c* so as to be mixed together even though the amount of the ink retained in the ink absorbent does not exceed the predetermined value. As a result, ink cohesion occurs in the mixing zone 22*c* so as to produce a solid.

The following effect can be achieved with the ink-jet recording apparatus 52 according to this embodiment in addition to the effects as in the case for the first embodiment. That is to say, since the lower portion of the ink absorbent 22 is partitioned by the partition 14, the first ink and the second ink are not mixed together. Therefore, the first ink and the second ink can be appropriately retained in a separate manner in the ink absorbent 22.

Fourth Embodiment

Figure 7:
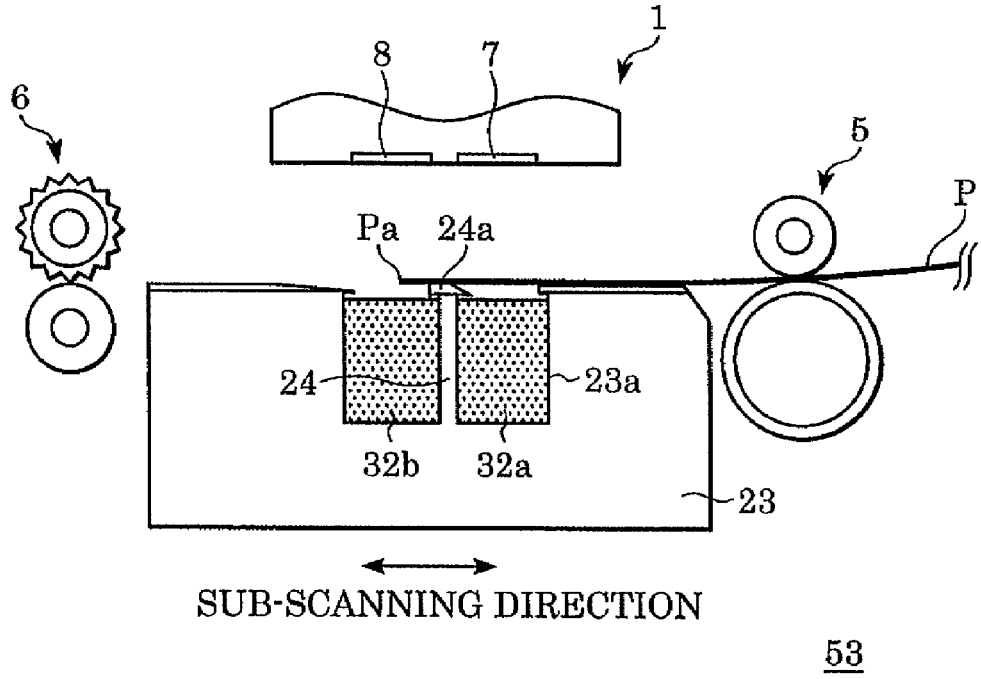
FIG. 7 is a cross-sectional view schematically illustrating an ink-jet recording apparatus according to a fourth embodiment.
Figure 8:
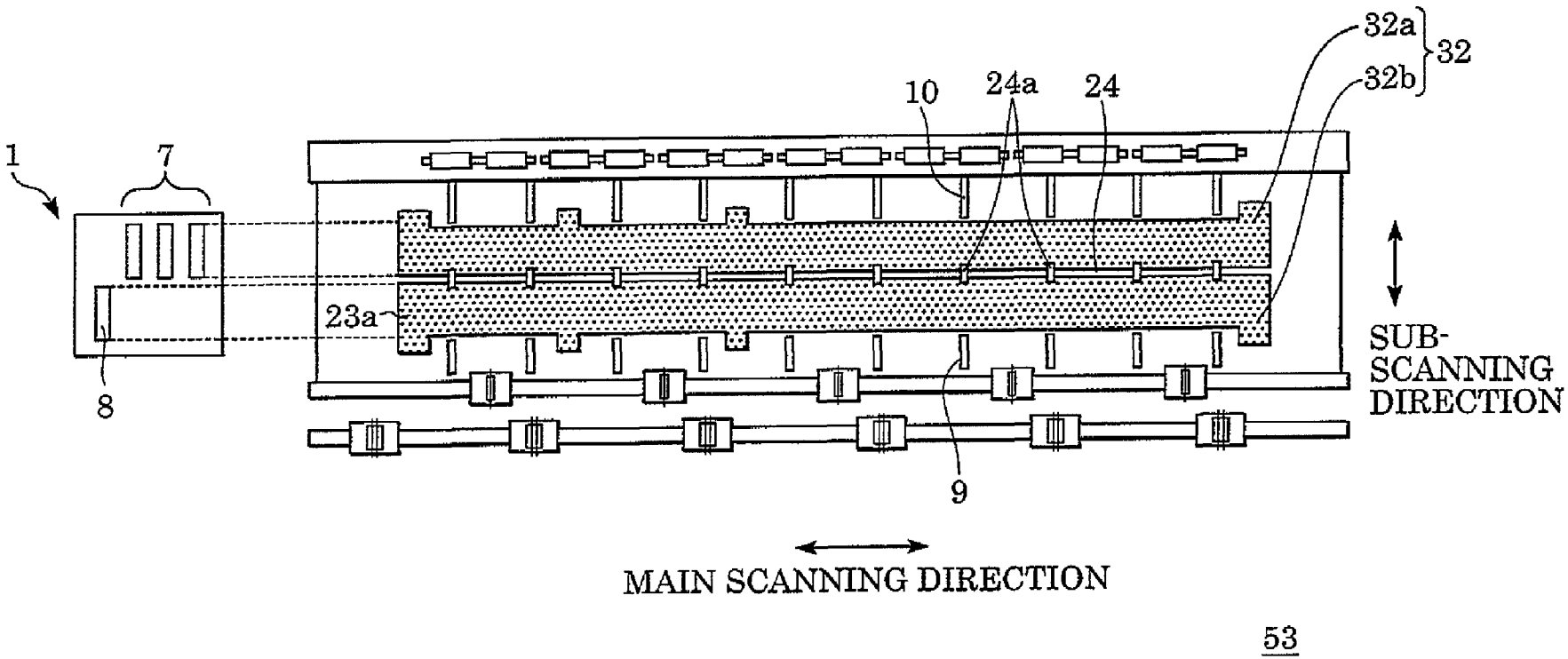
FIG. 8 is a top plan view of the ink-jet recording apparatus shown in FIG. 7.
Figure 9:
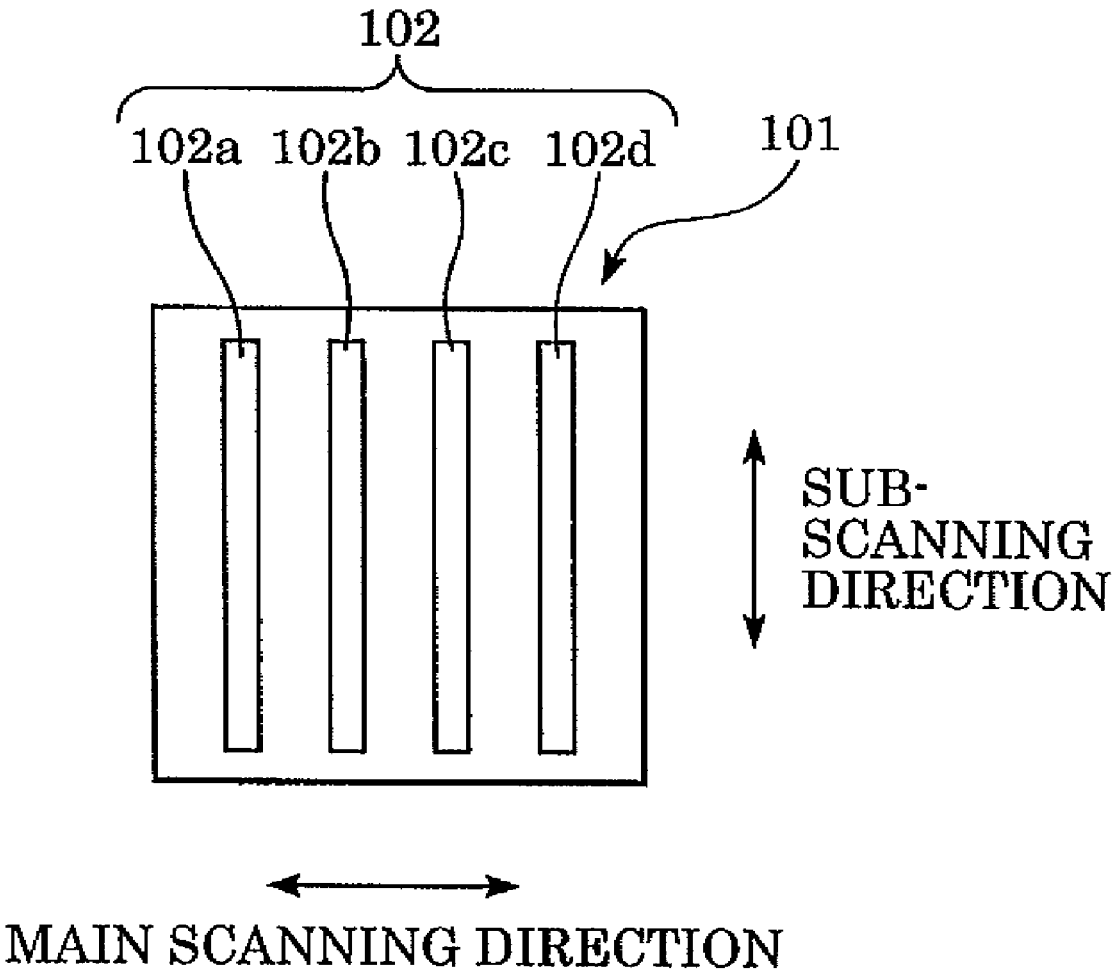
FIG. 9 PRIOR ART
FIG. 9 illustrates an exemplary layout of nozzle arrays of a known recording head installed in an ink-jet recording apparatus.

The shapes of the ink absorbent and the groove of the platen may be formed as in the case shown in FIGS. 7 and 8. FIG. 7 is a cross-sectional view schematically illustrating the ink-jet recording apparatus according to a fourth embodiment, and FIG. 8 is a top plan view of the ink-jet recording apparatus shown in FIG. 7.

In an ink-jet recording apparatus 53 shown in FIG. 7, a partition 24 inside a groove 23*a* of a platen 23 extends further upward as compared with the partition 14 according to the third embodiment, and the top thereof is substantially on the same level as the top surface of the platen 23. The groove 23*a* is partitioned into an upstream part and a downstream part by the partition 24 over the length in the longitudinal direction (see FIG. 8).

Furthermore, as shown in FIG. 7, a plurality of ribs 24*a* is formed on the top of the partition 24 so as to support the undersurface of the recording medium P. The top surfaces of the ribs 24*a* are inclined so as to smoothly guide the front edge Pa of the incoming recording medium P. As shown in FIG. 8, the ribs 24*a* are disposed at the same intervals as those of the ribs 9 and 10 in the main scanning direction.

Separate ink absorbing elements 32*a* and 32*b* are disposed inside the groove 23*a*.

The following effect can be achieved with the ink-jet recording apparatus 53 according to this embodiment in addition to the effects as in the case for the first embodiment. That is to say, since groove 23*a* is partitioned by the partition 24, the first ink and the second ink discharged to the ink absorbing element 32*a* and the ink absorbing element 32*b*, respectively, are not mixed together. Therefore, the problem of ink cohesion does not occur. Additionally, the recording medium P is retained more stably since the ribs 24*a* are formed substantially in the center of the groove 23*a* in the sub-scanning direction. As a result, the quality of the image produced on the recording medium P is further improved. Moreover, a problem of jamming of a sheet material that occurs when the front edge Pa of the recording medium P comes into contact with an inner wall of the groove 23*a* can be further prevented by the effect of the ribs 24*a*.

In the above-described embodiments, an additional waste-ink absorbent that finally absorbs and retains waste ink may be provided in addition to the ink absorbent 2, 12, 22, or 32. Also in this case, the waste-ink absorbent is partitioned into a zone for the first ink and a zone for the second ink as in the case for the above-described ink adsorbents. Also, when grooves or holes are formed so as to guide the ink from the ink absorbents to the waste-ink absorbent, these structures can be partitioned into two parts for the first ink and the second ink.

The ink absorbents 2, 12, 22, and 32 may be composed of a porous material including, for example, polypropylene or polyethylene instead of polyurethane foam. Moreover, the ink absorbents may have partially different capillary forces, and in particular, the capillary force adjacent to the bottom surface of the ink absorbents can be larger than that adjacent to the top surface. When the capillary force adjacent to the bottom surface of the ink absorbents is relatively large, the ink absorbed by the ink absorbents and moving substantially downward by their own weight can move downward more easily.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet recording apparatus, comprising:

a recording head including at least a first nozzle array configured to discharge a first ink and a second nozzle array configured to discharge a second ink, the first nozzle array and the second nozzle array being disposed along a feeding direction of a recording medium, the first ink and the second ink cohering with each other when mixed together; and an ink absorbent disposed at a position facing the first and second nozzle arrays, wherein during a frameless recording operation, some of the first and second ink discharged from the first and second nozzle arrays while the recording head moves in a direction orthogonal to the feeding direction of the recording medium adheres to an end of the recording medium, and wherein the first nozzle array and the second nozzle array are shifted with respect to each other in the feeding direction of the recording medium such that, during the frameless recording operation, the first ink not adhering to the end of the recording medium adheres to a first position on the ink absorbent and the second ink not adhering to the end of the recording medium adheres to a second position on the ink absorbent, and wherein the first nozzle array and the second nozzle array are disposed so as to partially overlap with each other in the moving direction of the recording head.

2. The ink-jet recording apparatus according to claim 1, wherein the first position on the ink absorbent is located upstream with respect to the second position on the ink absorbent.

3. The ink-jet recording apparatus according to claim 1, wherein one of the first ink and the second ink includes an anionic group, and the other one includes at least one of a polyvalent metal salt and a cationic compound.

4. The ink-jet recording apparatus according to claim 1, wherein the first ink is discharged from a part of the first nozzle array and the second ink is discharged from a part of the second nozzle array during the frameless recording operation, the part of the first nozzle array not overlapping with the part of the second nozzle array in the moving direction of the recording head.

* * * * *